US006923448B2

(12) United States Patent
Fairbanks

(10) Patent No.: US 6,923,448 B2
(45) Date of Patent: Aug. 2, 2005

(54) TOSSING GAME METHOD

(76) Inventor: John Patrick Fairbanks, 69 Delaney Ct., Roseville, CA (US) 95678

( * ) Notice: Subject to any disclaimer, the term of this patent is extended or adjusted under 35 U.S.C. 154(b) by 0 days.

(21) Appl. No.: 10/885,839

(22) Filed: Jul. 6, 2004

(65) Prior Publication Data

US 2004/0239036 A1 Dec. 2, 2004

Related U.S. Application Data

(63) Continuation of application No. 10/388,906, filed on Mar. 13, 2003, now abandoned.

(51) Int. Cl.[7] ..... A63B 63/04
(52) U.S. Cl. ..... 273/400
(58) Field of Search ..... 273/398–402

(56) References Cited

U.S. PATENT DOCUMENTS

| | | | | | |
|---|---|---|---|---|---|
| 1,114,523 | A | * | 10/1914 | Revell | 273/354 |
| 3,100,642 | A | * | 8/1963 | Goldstein | 206/579 |
| 5,209,493 | A | * | 5/1993 | Chernek | 273/400 |
| 5,419,566 | A | * | 5/1995 | Byrd | 273/402 |
| 5,871,216 | A | * | 2/1999 | Sparacino | 273/402 |
| 2002/0175469 | A1 | * | 11/2002 | Kessler et al. | 273/400 |

* cited by examiner

*Primary Examiner*—Mark S. Graham
(74) *Attorney, Agent, or Firm*—Daniel P. Maguire

(57) ABSTRACT

A method for a modified "Washers" tossing game are revealed. The method includes using modular panels with slots, colored washers, and stakes. Using the kit, a simple or complex course consisting of different target areas can be constructed. Sample rules for the new game are also disclosed.

7 Claims, 5 Drawing Sheets

TOSSING GAME METHOD

RELATED APPLICATION

This application is a continuation of U.S. application Ser. No. 10/388,906, filed Mar. 13, 2003, now abandoned.

BACKGROUND OF THE INVENTION

1. Field of the Invention

This invention relates to tossing games.

2. General Background

"Washers" is a tossing game in which players try to throw standard washers into a target area. The target area for Washers has traditionally been a rectangular, open-ended box, with sand on the bottom to prevent the washers from bouncing out. The box is typically made of lumber 2×4s attached to a plywood base. An open-ended coffee can is typically placed in the middle. Higher points are awarded for landing in the coffee can, lower points are awarded for landing in the box, and no points are awarded for landing outside the box. So, for instance, one point can be awarded for landing in the outer target (the box), and three or five points can be awarded for landing in the inner target (the coffee can). Often, the game continues until one player or team scores 21 points.

Typically, the target area is placed 20 feet from the launching area. Because traditional Washers is more a game of skill than chance, teams may be randomly chosen to even up the odds.

Although traditional Washers is a popular and enjoyable game, it suffers from certain drawbacks. First, the target area—and hence the game itself—is not very portable, since it is composed of 2×4s fastened to a piece of plywood forming a rectangular box, sand, and a coffee can. Second, the sand may attract neighborhood cats who use the target area as a litter box. Third, the game is fairly predictable, since players are always aiming at the same target, over and over again.

Thus, there is a need for a portable Washers game, without sand, and with a variety of target shapes and sizes.

SUMMARY OF THE INVENTION

The present invention is a kit and system for a modified Washers game. The invention includes both a game and a kit to construct target areas for the game. The kit includes flexible, modular panels with slots, stakes, and washers. Using the kit, an entire course, similar to a golf course, can be constructed.

DETAILED DESCRIPTION

Figure 1:
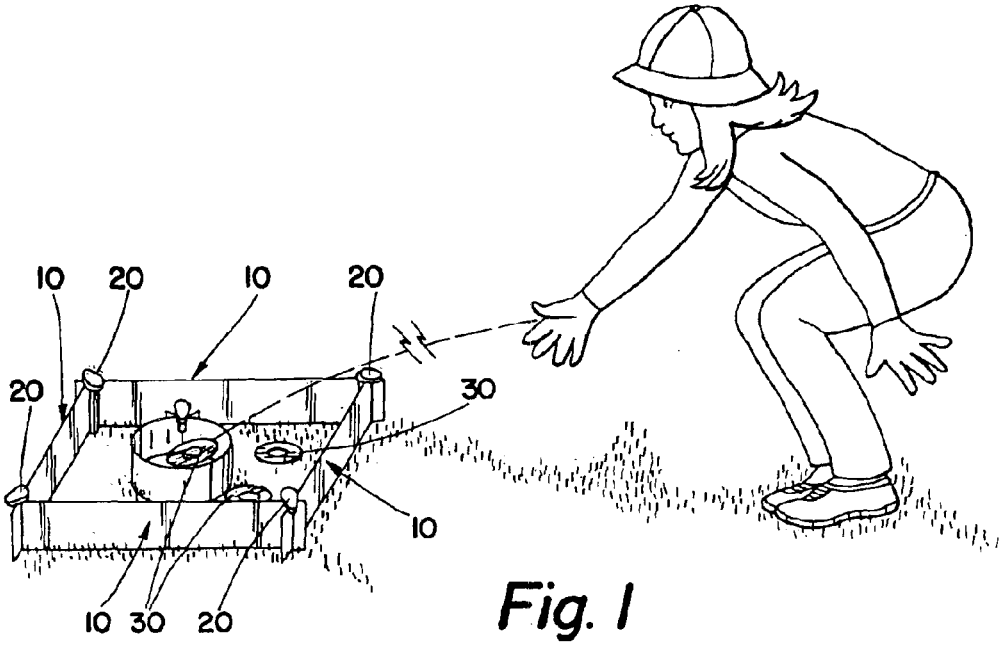
FIG. 1 is an environmental depiction of a player tossing washers into a target area according to the present invention.
Figure 2:
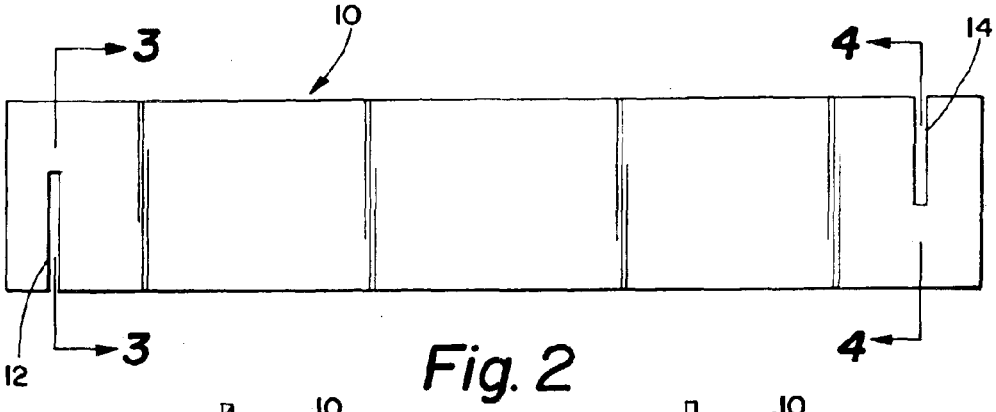
FIG. 2 shows a modular panel according to an embodiment of the present invention.
Figure 3:
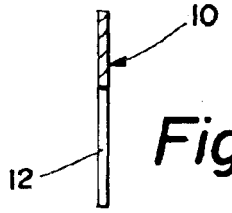
FIG. 3 is a cross sectional view of a modular panel according to an embodiment of the present invention, taken along line 3—3 of FIG. 2.
Figure 4:
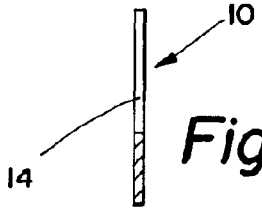
FIG. 4 is a cross sectional view of a modular panel according to an embodiment of the present invention, taken along line 4—4 of FIG. 2.
Figure 5:
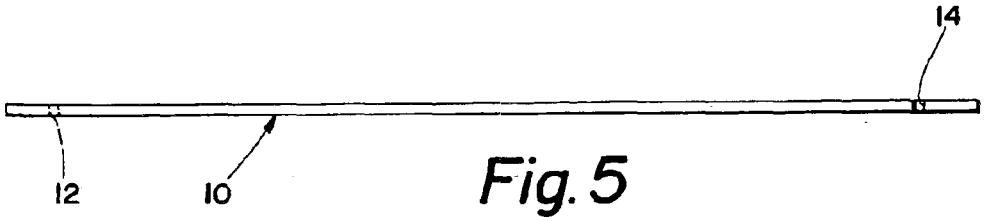
FIG. 5 is a top view of a modular panel according to an embodiment of the present invention.

The present invention is a system and device for a tossing game. It includes a game, and a kit to construct target areas for the game. The kit includes flexible, modular panels 10 with slots 12, 14, stakes 20, and washers 30. The kit may be used to construct an entire "course," similar to a golf course.

The modular panels 10 are used to create target areas. See FIGS. 1–12. The modular panels 10 can be made of many materials. For instance, the modular panels can be constructed of flexible plastic garden border material, or from ABS (acrylonitrile-butadiene-styrene) plastic. More preferably, they can be constructed of polystyrene, a strong plastic material made from erethylene and benzine.

The panels are typically rectangular, and can be a number of different sizes. In one embodiment, the panels are about 4.75 inches high, and about 24 inches long. With panels of this height, the washers are unlikely to bounce out, and therefore sand is not needed. To achieve modularity, all panels in a kit will typically have the same dimensions, although panels of varying sizes could also be used.

Each panel has two slots, an upper slot 12 facing one direction, and a lower slot 14 facing the other direction. See FIG. 2. As explained below, the slots are used to fasten the panels together.

Figure 6:
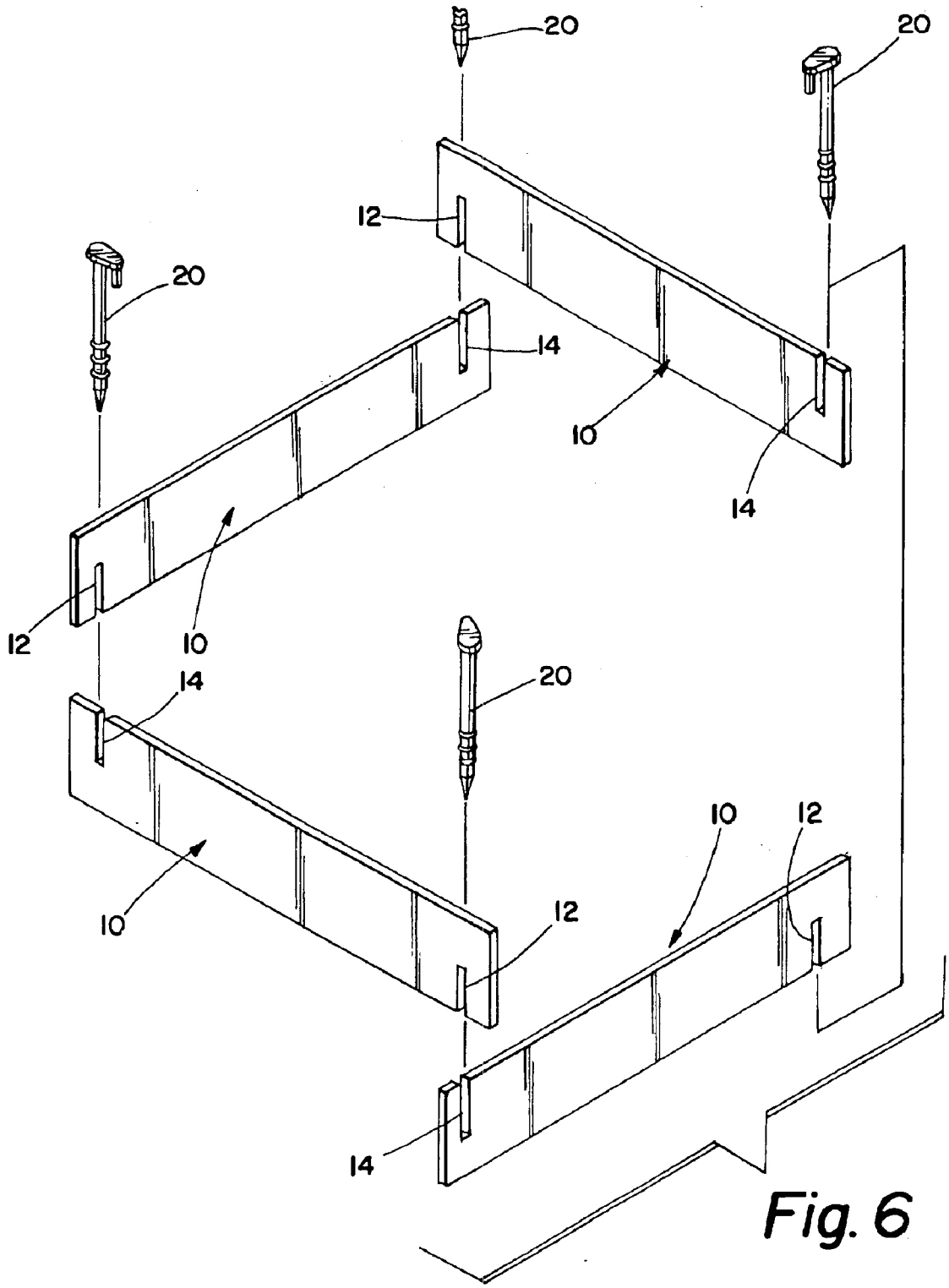
FIG. 6 is an exploded perspective view of a square target according to an embodiment of the present invention.
Figure 7:
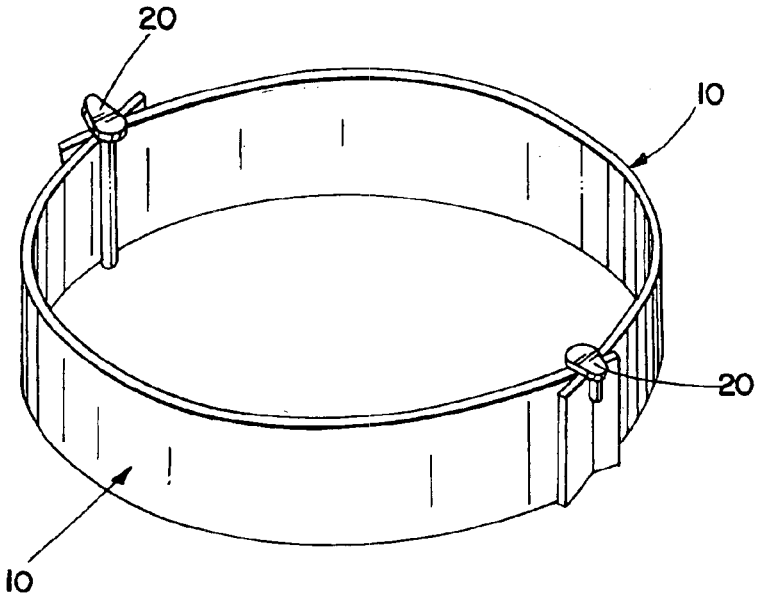
FIG. 7 is a perspective view of a two-piece circular target according to an embodiment of the present invention.
Figure 8:
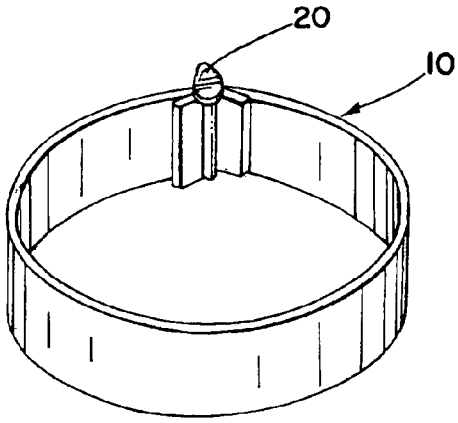
FIG. 8 is a perspective view of a one-piece circular target according to an embodiment of the present invention.
Figure 9:
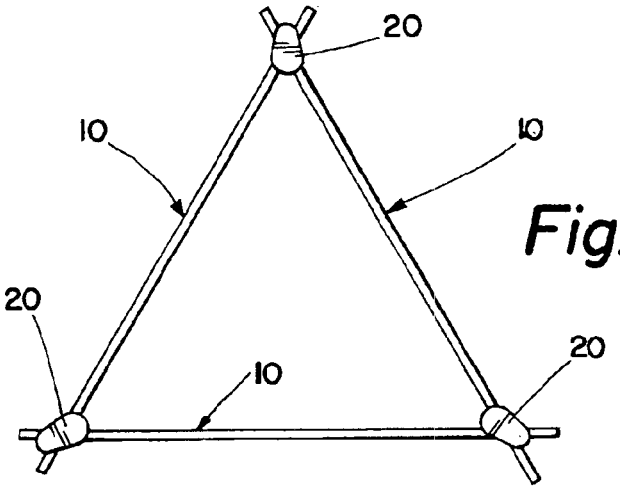
FIG. 9 is a top view of a triangular target according to an embodiment of the present invention.
Figure 10:
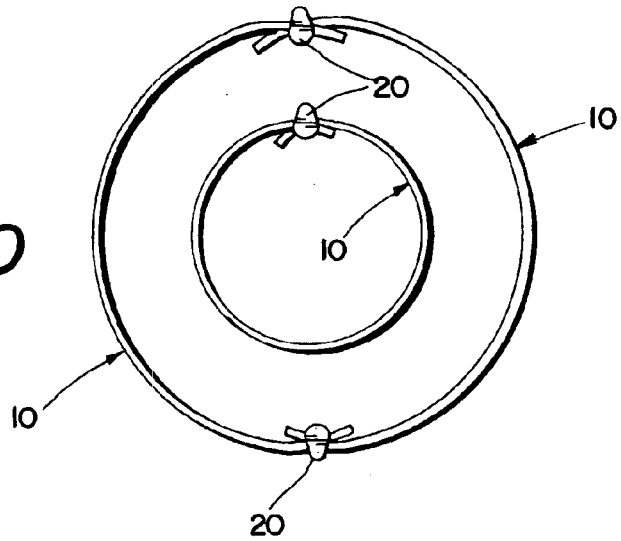
FIG. 10 is a top view of a target area comprised of concentric circular targets, according to an embodiment of the present invention.

The stakes 20 are used to hold the panels together, and also to hold the target area in the ground. See FIGS. 6, 7, and 8. They can be placed in any location that will accomplish this function, and in one embodiment they are placed in the inside of the target area, at the junction of two panels. See FIG. 7. As shown in FIG. 6, the stakes 20 may have hooks to grab the panels.

It is preferable to use stakes, but the present invention can be practiced without the stakes 20, simply by letting gravity and friction hold the panels down and together or by taping them to a surface such as carpet.

The washers 30 can be standard washers, of virtually any size or grade that can be easily tossed. Other discs or suitable objects can also be used, and all such tossing objects will be referred to as "playing pieces" in this patent. In one embodiment, the washers or discs will be painted different colors, so that players or teams can easily identify their washers.

To construct a target, the upper slot 12 of one panel 10 is mated with the lower slot 14 of another (or the same) panel. See FIG. 6. Targets of many different shapes can be constructed, including a one-piece circular target, see FIG. 8, a two-piece circular target, see FIG. 7, a three-piece triangular target, see FIG. 9, and a four-piece square target, see FIG. 6.

Figure 11:
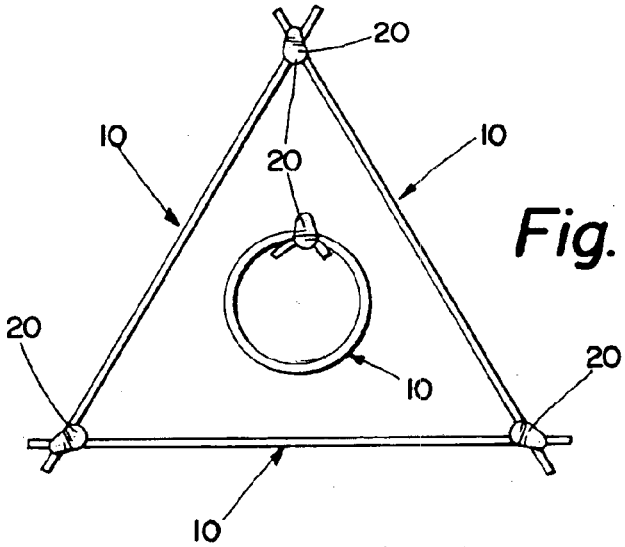
FIG. 11 is a top view of a target area comprised of a circular target within a triangular target, according to an embodiment of the present invention.
Figure 12:
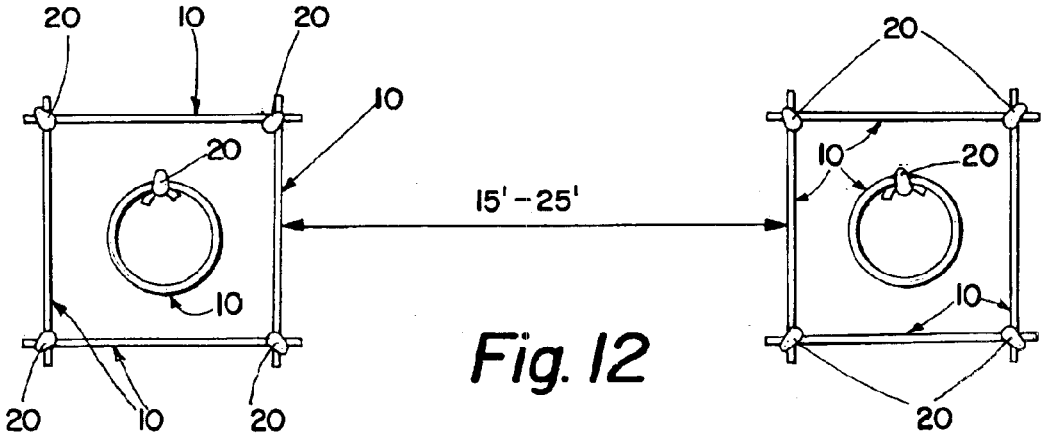
FIG. 12 shows a course with two target areas, according to an embodiment of the present invention.
Figure 13:
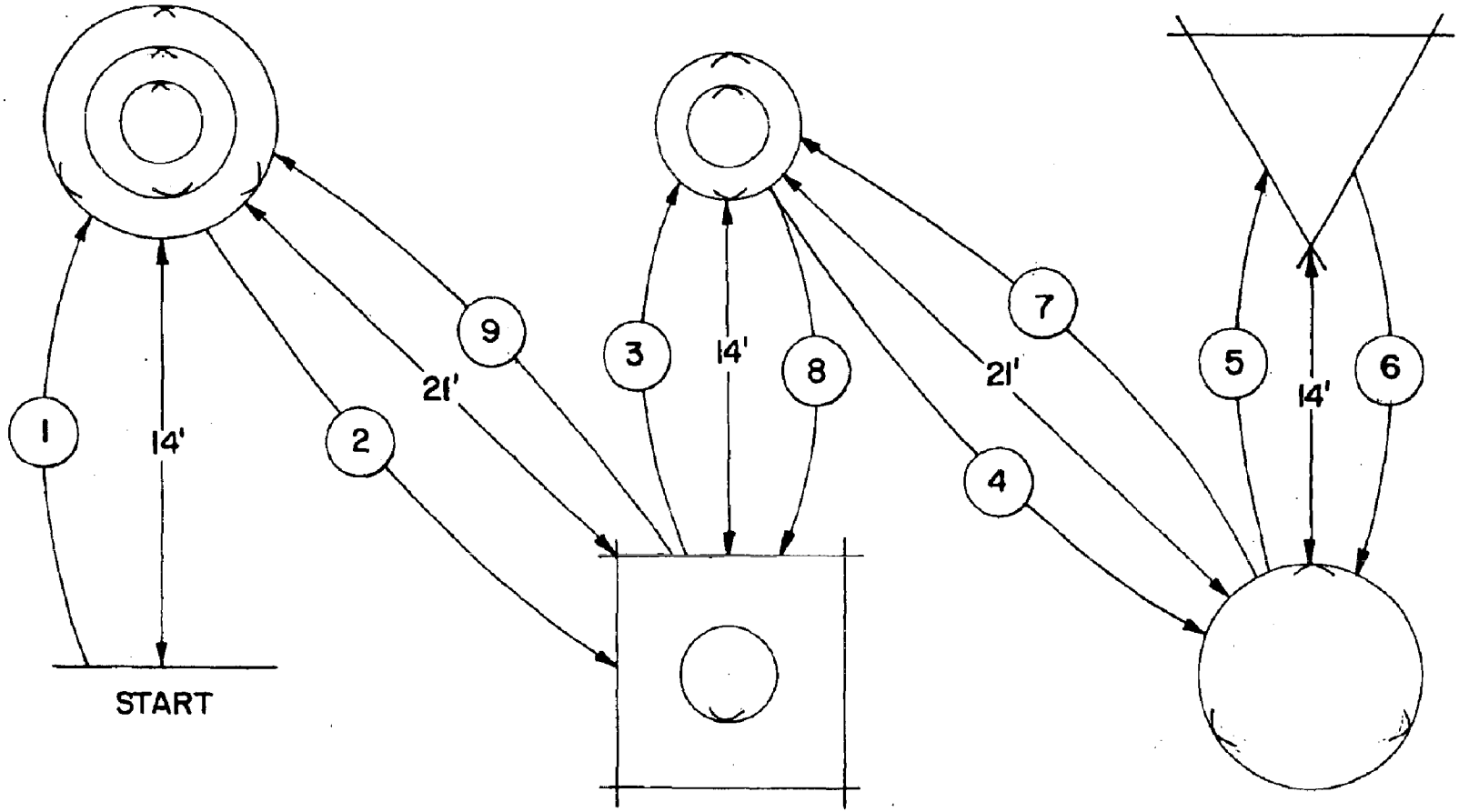
FIG. 13 shows a course with five target areas, according to an embodiment of the present invention.

Targets can be combined together to form more complex target areas. For instance, as shown in FIGS. 1, 12, and 13, a circular target can be placed inside a square target. Or a circular target can be placed inside a triangular target, as shown in FIG. 11. Or smaller circular targets can be placed inside larger circular targets, as shown in FIG. 13. Of course, many other combinations may be constructed.

A course can be made by combining target areas. A simple two target area course is shown in FIG. 12. A more complex "nine hole" course is shown in FIG. 13. FIGS. 12 and 13 show sample distances between holes or target areas in these courses.

There are a number of ways to play the game of the present invention. In one embodiment, when a number of target areas are used, points can be assigned according to the difficulty of landing in the target area. The difficulty of each target area in the course depends on the ratio between the area inside the target and the distance from the launching area to the target. For instance, a two-piece circular target has a little less than half the area of a three-piece circular target. Thus, two points might be awarded for tossing a washer into the smaller circular target, and one point for tossing into the larger circular target.

Of course, if two targets have the same area, distance is the only variable. Doubling the distance also results in about twice the angular accuracy requirement, making the difficulty about 4 times as much. Increasing the distance by 1.414 (square root of two) doubles the difficulty. Therefore, assigning twice the points to a 20 foot hole as are assigned to a 14 foot hole is consistent with the level of difficulty.

Once it has been decided how many points are to be allocated to a given target area on the course, the points can be allocated to the inner and outer targets of the target area in a discretionary manner. In one embodiment, the product of the points for a target multiplied by its area in square feet can equal the points for other targets multiplied by their area in square feet.

For a simple game, as depicted in FIG. 12, the target areas can be spaced between 15 to 25 feet across for teenagers and adults, and about 15 feet for children. One point is awarded for landing in the outer target, and five points are awarded for landing in the inner target. Scores are tabulated based on where the washer finally lands, so if washer bounces into a target, it is counted as having landed in the target, and if it bounces out of a target, it is not counted as landing in the target. If a washer stops on the top of the wall or slides under the wall of a target, it is counted as "in" if it is more than halfway inside the perimeter. The game ends when a team reaches 21 points. In the event of a tie at 21, a "playoff" is held under which the teams that are tied continuing playing until one is ahead. Each team throws four washers per turn, and the winner of a hole throws first on the next hole. If there is a tie on a particular hole, the priority remains unchanged for the next hole. Very young children frequently want to go first, and the rules of the game can be bent to allow them to do so. Up to four teams can play at one time, with each team using playing pieces of different colors. Teams can have one or two players, and for two-player teams, the players will alternate turns, one tossing into each of the targets.

The layout and spacing for a more complex course are provided in FIG. 13. Difficulty is proportional to the square of the distance, so the same target will score twice as high from 20 feet as from 14 feet. Distances can be scaled to accommodate preferences or the skill level of the players. When a complex course is used, the game can continue until all players finish the course, rather than ending when a predetermined number of points have been scored.

The table below provides a sample scoring system for the course shown in FIG. 13:

| Hole | Distance | Outer Target | Middle Target | Inner Target |
|---|---|---|---|---|
| 1 | 14' | 1 | 3 | 5 |
| 2 | 20' | 2 | — | 10 |
| 3 | 14' | 3 | — | 5 |

-continued

| Hole | Distance | Outer Target | Middle Target | Inner Target |
|---|---|---|---|---|
| 4 | 20' | 2 | — | — |
| 5 | 14' | 2 | — | — |
| 6 | 14' | 1 | — | — |
| 7 | 20' | 6 | — | 10 |
| 8 | 14' | 1 | — | 5 |
| 9 | 20' | 2 | 6 | 10 |

The scoring scheme purposefully includes a last hole that is rich with points. By reserving a great number of points until the end, the game will remain interesting and competitive for the entire playing period.

The modified Washers game disclosed herein is appropriate for people of virtually all ages and abilities. The game reduces the predictability of traditional Washers, by providing for holes of varying layout and difficulty. The game kit also is much more portable than the one used in traditional Washers.

One skilled in the art will appreciate that the present invention can be practiced by other than the preferred embodiments, which are presented for purposes of illustration and not of limitation.

I claim:

1. A method of playing a tossing game, comprising:

providing a plurality of modular panels, wherein at least one of said panels can mate with itself to form a circle and wherein each of said panels is the same size;

selecting a first desired shape;

using at least one of said modular panels to create a first target of said first desired shape;

selecting a second desired shape;

using a plurality of said modular panels to create a second target of said second desired shape, wherein said second desired shape is not the same shape as said desired first shape; and attempting to toss playing pieces into said first target.

2. The method according to claim 1, additionally comprising:

selecting a third desired shape;

using a plurality of said modular panels to create a third target of said third desired shape, wherein said third desired shape is not the same shape as said first desired shape or said second desired shape.

3. The method of claim 1, wherein each of said panels is slotted.

4. The method of claim 1, additionally comprising:

awarding points for landing the playing pieces in said first target, wherein the points awarded are based on the area of the first target and its distance from players.

5. The method of claim 1, additionally comprising:

attempting to toss playing pieces into said second target; and awarding points for landing the playing pieces in said second target, wherein the points awarded are based on the area of the second target and its distance from players.

6. The method of claim 2, additionally comprising:

attempting to toss playing pieces into said third target; and awarding points for landing the playing pieces in said third target, wherein the points awarded are based on the area of the third target and its distance from players.

7. The method of claim 1, additionally comprising providing stakes to anchor said targets.

* * * * *